US011804342B2

(12) United States Patent
Zhu

(10) Patent No.: US 11,804,342 B2
(45) Date of Patent: Oct. 31, 2023

(54) MEMBRANE SWITCH, KEY AND KEYBOARD

(71) Applicant: Suzhou You Yue Electronics Co., Ltd., Suzhou (CN)

(72) Inventor: Yabing Zhu, Suzhou (CN)

(73) Assignee: SUZHOU YOU YUE ELECTRONICS CO., LTD., Suzhou (CN)

( * ) Notice: Subject to any disclaimer, the term of this patent is extended or adjusted under 35 U.S.C. 154(b) by 44 days.

(21) Appl. No.: 17/678,653

(22) Filed: Feb. 23, 2022

(65) Prior Publication Data

US 2023/0142935 A1 May 11, 2023

(30) Foreign Application Priority Data

Nov. 10, 2021 (CN) ..... 202111326606.0
Nov. 10, 2021 (CN) ..... 202111327914.5

(51) Int. Cl.
*H01H 13/83* (2006.01)
*H01H 13/7065* (2006.01)
*H01H 13/06* (2006.01)

(52) U.S. Cl.
CPC ..... *H01H 13/7065* (2013.01); *H01H 13/06* (2013.01); *H01H 13/83* (2013.01)

(58) Field of Classification Search
CPC ..... H01H 13/83; H01H 2219/062; H01H 2219/039; H01H 13/023; H01H 2219/06; H01H 2221/07; H01H 9/181; H01H 2219/036; H01H 2219/044; H01H 2013/026; H01H 9/16; H01H 2219/0622; H01H 2219/037; H01H 3/125; H01H 2219/056; H01H 2219/04; H01H 2207/04; G02B 6/0068
See application file for complete search history.

(56) References Cited

U.S. PATENT DOCUMENTS

2018/0040439 A1* 2/2018 Chen ..... H01H 13/703
2018/0106956 A1* 4/2018 Wang ..... G02B 6/0068
2019/0228932 A1* 7/2019 Lin ..... H01L 33/507

* cited by examiner

*Primary Examiner* — Ahmed M Saeed

(57) ABSTRACT

The present disclosure provides a membrane switch, a key, and a keyboard. The membrane switch includes: a flexible substrate; a switch trace layer, disposed on a front surface of the flexible substrate, and comprising a plurality of conductive contacts that not in contact with each other; a flexible key, covering the switch trace layer, a press cavity being defined between an inner wall of the flexible key and the flexible substrate; and a conductor, disposed in the press cavity, and configured to be connected to the plurality of conductive contacts in response to the flexible key being pressed, such that the switch trace layer is conducted. The membrane switch, the key, and the keyboard according to the present disclosure have a compact structure, a high integration degree, and a small thickness, and thus accommodate demands of the market on lightening and thinning.

18 Claims, 18 Drawing Sheets

MEMBRANE SWITCH, KEY AND KEYBOARD

TECHNICAL FIELD

The present disclosure relates to the technical field of membrane switches, and in particular, relates to a membrane switch, an illuminated key, and an illuminated keyboard.

BACKGROUND

A membrane switch is also referred to as a light touch keyboard, which employs an integral closed structure composed of a plurality of planar layers, and is a novel electronic device integrating a key switch, a panels, a marker, symbol display, and a backplane. The membrane switch is widely applied in various electronic products. The membrane switch mainly includes an upper trace board, an isolation layer, and a lower trace board. In the case that the membrane switch is pressed, a contact on the upper trace board is deformed downward, and is contact with a contact on the lower trace board and conducted to the contact to generate a signal. In addition, to accommodate requirements of consumers for light emitting responsive to pressing, a light-emitting layer needs to be additionally configured under the membrane switch.

As the electronic products are being designed ultra-thin, and lightweight, the conventional membrane switch fails to accommodate market requirements. Therefore, it is necessary to make some improvements on the structure of the membrane switch.

SUMMARY

To overcome the above defect, the present disclosure is intended to provide a membrane switch, a key, and a keyboard, which have a high integration degree and a small thickness, and thus accommodate demands of the market on lightening and thinning.

In view of the above object, the present disclosure employs one technical solution of a membrane switch. The membrane switch includes: a flexible substrate; a switch trace layer, disposed on a front surface of the flexible substrate, and including a plurality of conductive contacts that not in contact with each other; a flexible key, covering the switch trace layer, and defining a press cavity with the flexible substrate; and a conductor, disposed in the press cavity, and configured to be connected to the plurality of conductive contacts in response to the flexible key being pressed, such that the switch trace layer is conducted.

The present disclosure achieves the following beneficial effects:

1. The circuit board and the isolation layer in the related art are canceled, and the switch trace layer having the functionality of a switch circuit is directly integrated on a flexible substrate. That is, the original three-layer structure (an upper circuit board, an isolation layer, and a lower circuit board) are integrated as a one-layer structure (the flexible substrate), and the trace on the upper circuit board and the trace on the lower circuit board are integrated as one switch trace layer. In this way, an overall thickness of the membrane switch is effectively reduced.

2. In the switch trace layer, a plurality of conductive contacts that are not in contact with each other cause the switch trace layer to be in a non-conducted state when not being applied with a force, such that the switch trace layer acts as a switch circuit; and pressing exerted by the flexible key on the conductor causes the conductor to be in contact with the conductive contacts. In this way, the conductive contacts are triggered to conduct the switch trace layer, and a press signal of the key is generated.

3. The switch trace layer, the flexible key, and the conductor are all integrated on the flexible substrate, such that the entire structure of the membrane switch is more compact, the thickness of the membrane switch is reduced, and hence the membrane switch more accommodates market requirements.

Furthermore, the membrane switch further includes a light-emitting assembly; wherein the light-emitting assembly is integrated on the flexible substrate and configured to generate a light beam, the light-emitting assembly comprises a light-emitting circuit integrated on a back surface of the flexible substrate, and the front surface of the flexible substrate is provided with a plurality of sites that are conducted to the light-emitting circuit; wherein the plurality of sites surrounding outside the flexible key, and a built-in drive IC-mounted LED is mounted on each of the sites.

Where a light emitting function needs to be configured for the conventional membrane switch, a light-emitting layer needs to be further configured under the membrane switch. That is, the original three-layer structure (the upper circuit board, the isolation layer, and the lower circuit board) needs to be designed to a four-layer structure (the upper circuit board, the isolation layer, the lower circuit board, and the light-emitting layer). This inevitably causes the membrane switch to have a great overall thickness and to occupy a large space. Therefore, on the premise of integrating the switch trace layer, the flexible key, and the conductor on the flexible substrate, according to the present disclosure, a light-emitting assembly is directly integrated on the flexible substrate, which is equivalent to integrating the four-layer structure as a single-layer structure, such that the overall thickness of the membrane switch is effectively reduced. In this way, the light-emitting assembly and the switch trace layer are integrated on the flexible substrate, and the thickness of the membrane switch is reduced while turn-on or turn-off of the membrane switch and the light emitting function are ensured, such that the entire structure of the membrane switch is more compact, the thickness is further reduced, and the membrane switch more accommodates market requirements.

In addition, by the built-in drive IC-mounted LED, a built-in drive IC is internally configured in the LED. In this way, the single LED is independently controlled, and further the mounting space for additionally mounting an IC control module is saved, such that the light-emitting assembly is more compact and has a smaller thickness.

Furthermore, the built-in drive IC-mounted LED includes an insulative body, a conductive terminal, a built-in drive IC, a light-emitting chip, a light-transmissive cap. The insulative body is fixedly connected to flexible substrate, wherein the conductive terminal conducted to a site is provided on the insulative body. The built-in drive IC and the light-emitting chip are both fixedly connected to the conductive terminal, and the built-in drive IC and the light-emitting chip are connected via a conductive wire. The light-transmissive cap covers the built-in drive IC and the LED, and is fixed to the insulative body. The insulative body isolates the built-in drive IC and the light-emitting chip from the flexible substrate, and Furthermore, the conductor is a metal snap dome covering the switch trace layer; wherein an edge of the metal snap dome is fixedly connected to the flexible substrate. Configuration of the metal snap dome not only implements the electricity conduction function of the conductor, but also implements the press-induced rebounding function of the elastic sheet. In addition, during pressing, strong mechanical tapping sound is generated, which accommodates customized requirements of different users.

Furthermore, the press cavity is internally provided with a silicone elastic sheet covering the switch trace layer, and the conductor is a conductive silver slurry coated on an inner wall of a side, facing toward the switch trace layer, of the silicone elastic sheet; wherein the conductive silver slurry is coated right above the switch trace layer. Relative to the metal snap dome, the silicone elastic sheet has a better press-induced elasticity, and achieves a good noise absorbing effect, which accommodates customized requirements of different users. Coating the conductive silver slurry directly on the silicone elastic sheet saves the mounting space of the conductor.

Further, the press cavity is internally provided with a silicone elastic sheet covering the switch trace layer, the silicone elastic sheet is internally provided with an insulative layer surrounding an outer side of the switch trace layer, an upper end face of the insulative layer being higher than an upper end face of the switch trace layer, and the conductor being mounted on the upper end face of the insulative layer; wherein a press gap is defined between the silicone elastic sheet and the conductor. Configuration of the insulative layer causes the conductor and the switch trace layer to have an isolation gap therebetween, which prevents the conductor from being in direct contact with the switch trace layer in a non-pressing state. As compared with coating the conductive silver slurry directly on the silicone elastic sheet, by the insulative layer built in the silicone elastic sheet, and the conductor, the life time of the silicone elastic sheet may be effectively prolonged.

Further, the press cavity is internally provided with a silicone elastic sheet covering the switch trace layer, the silicone elastic sheet is internally provided with an insulative layer surrounding an outer side of the switch trace layer, an upper end face of the insulative layer being higher than an upper end face of the switch trace layer; wherein a PET flat plate is mounted on the upper end face of the insulative layer, a press gap being defined between the PET flat plate and the silicone elastic sheet; and the conductor is a conductive silver slurry coated on a lower end face of the PET flat plate.

Furthermore, the insulative layer has a thickness of 2 to 4 μm or 8 to 12 μm. In the case that the thickness of the insulative layer is 2 to 4 μm, the insulative layer is only slightly higher than the upper end face of the switch trace layer. In the case of moisture spreading, the moisture may simply override the insulative layer and enter the switch trace layer. Therefore, in the case that the thickness of the insulative layer is 2 to 4 μm, the insulative layer only achieves an effect of isolating the conductor from the switch trace layer. In the case that the thickness of the insulative layer is 8 to 12 μm, the insulative layer not only isolates the conductor from the switch trace layer, but also blocks the moisture out of the insulative layer, thereby preventing the moisture from overriding the insulative layer and entering the switch trace layer.

Furthermore, the membrane switch further includes a waterproof structure; wherein the waterproof structure is a waterproof layer surrounding an outer side of the flexible key, a lower end of the waterproof layer being fixedly connected to the flexible substrate, and an upper end face of the waterproof layer being higher than the upper end face of the switch trace layer. Configuration of the waterproof layer blocks the moisture, and prevents the moisture from causing the switch trace layer to be oxidized.

Furthermore, the insulative layer has a height of 2 to 4 μm, and the waterproof layer has a height of 8 to 12 μm. In this case, the insulative layer isolates the conductor from the switch trace layer, and the waterproof layer blocks the moisture out of the flexible key.

Furthermore, the switch trace layer is a copper foil trace pattern etched on a surface of the flexible substrate, the copper foil trace pattern comprising a pair of meandering-shaped copper foil traces that are not in contact with each other, each of the meandering-shaped copper foil traces being provided with at least one conductive contact; wherein one of the meandering-shaped copper foil traces is a positive pole trace and the other of the meandering-shaped copper foil traces is a negative pole trace; and the positive pole trace and the negative pole trace are conducted in the case that the conductor is in contact with the conductive contacts on the two meandering-shaped copper foil traces.

Furthermore, the switch trace layer is a copper foil trace pattern etched on a surface of the flexible substrate, the copper foil trace pattern comprising a pair of comb finger-shaped copper foil traces that are not in contact with each other and interdigitated, each of the comb finger-shaped copper foil traces being provided with at least one conductive contact; wherein one of the comb finger-shaped copper foil traces is a positive pole line and the other of the comb finger-shaped copper foil traces is a negative pole trace In view of the above object, the present disclosure employs another technical solution of a key. The key includes the membrane switch as described above. The key fabricated using the above membrane switch, relative to the conventional key, has a more compact structure and a smaller thickness, and accommodates the market requirements of lightweight and ultra-thinness.

In view of the above object, the present disclosure employs still another technical solution of a keyboard. The keyboard includes a keyboard substrate, wherein the keyboard substrate is provided with a plurality of keys which employ the key as described above. The keyboard fabricated using the above key has a compact structure and a small thickness, and accommodates the market requirements of lightweight and ultra-thinness.

REFERENCE NUMERALS AND DENOTATIONS THEREOF

11—Flexible substrate; 12—switch trace layer; 121*a*, 121*b*—meandering-shaped copper foil trace; 122*a*, 122*b*, 124*a*, 124*b*—conductive contact; 123*a*, 123*b*—comb finger-shaped copper foil trace; 131—light-emitting circuit; 132—site; 133—LED; 1331—insulative body; 1332—conductive terminal; 1333—light-transmissive cap; 1334—light-emitting chip; 1335—built-in drive IC; 2—flexible key; 21—press cavity; 22—key body; 23—key contact; 3—conductor; 4—silicone elastic sheet; 5—insulative layer; 6—PED flat plate; and 7—waterproof layer.

DETAILED DESCRIPTION

Preferred embodiments of the present disclosure are described in detail with reference to the accompanying drawings to make the advantages and features of the present disclosure better understood by a person skilled in the art, such that the projection scope of the present disclosure are more clearly defined.

EMBODIMENTS

First Embodiment

Figure 1:
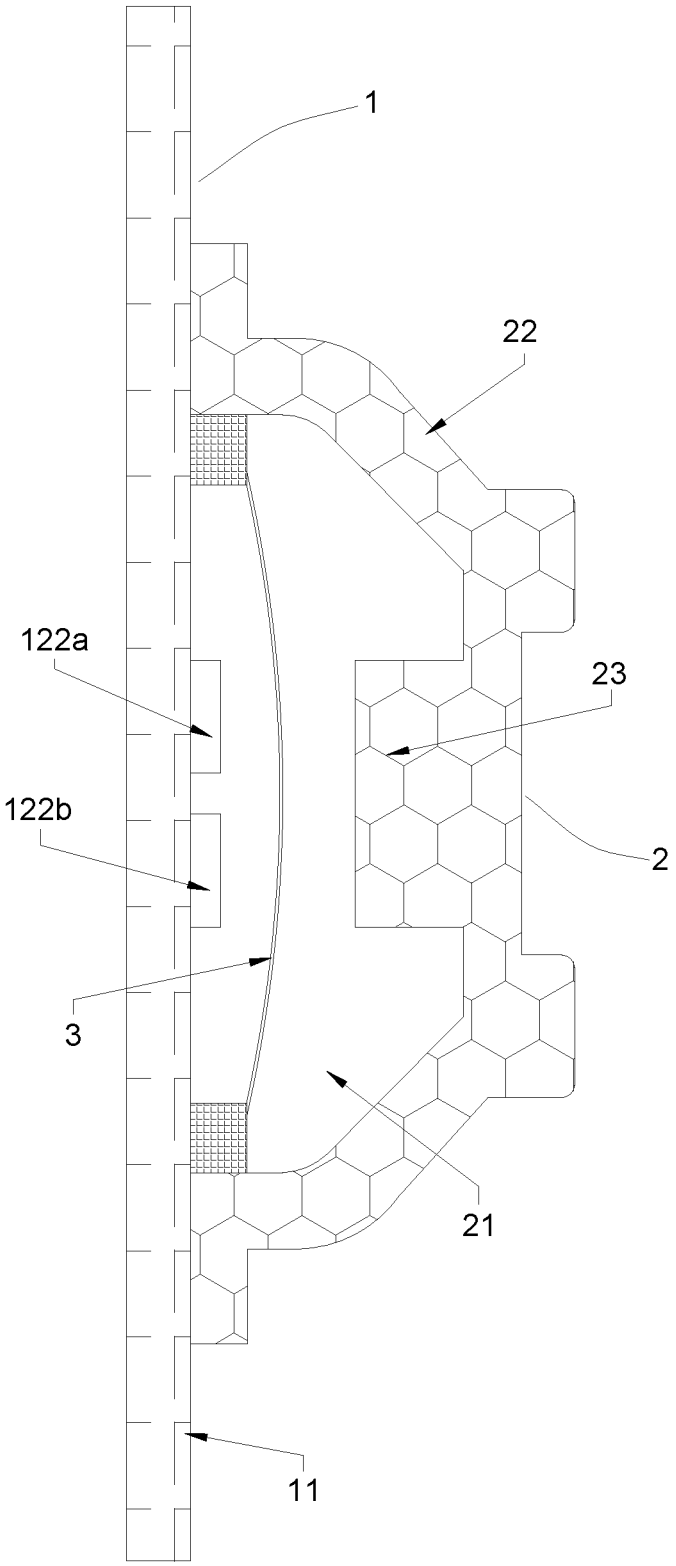
FIG. 1 is a schematic structural view of a membrane switch according to a first embodiment of the present disclosure.
Figure 2:
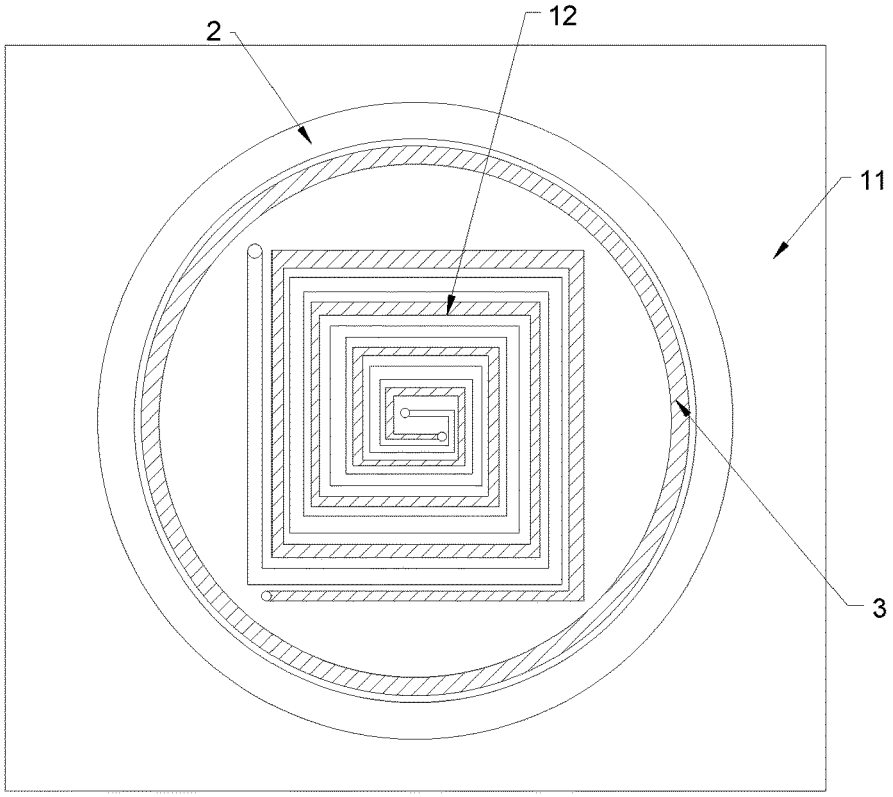
FIG. 2 is a schematic top view of a flexible substrate in the membrane switch according to the first embodiment of the present disclosure.

Referring to FIG. 1 and FIG. 2, this embodiment of the present disclosure provides a membrane switch. The membrane switch includes a flexible substrate 11, a flexible key 2, and a conductor 3. The flexible substrate 11 is provided with a switch trace layer 12, and the flexible key 2 covers the switch trace layer 12 and defines, together with the flexible substrate 11, a press cavity 21. The conductor 3 is disposed inside the press cavity 21, and is configured to conduct the switch trace layer 12 in response to the flexible key 2 being pressed.

Figure 3:
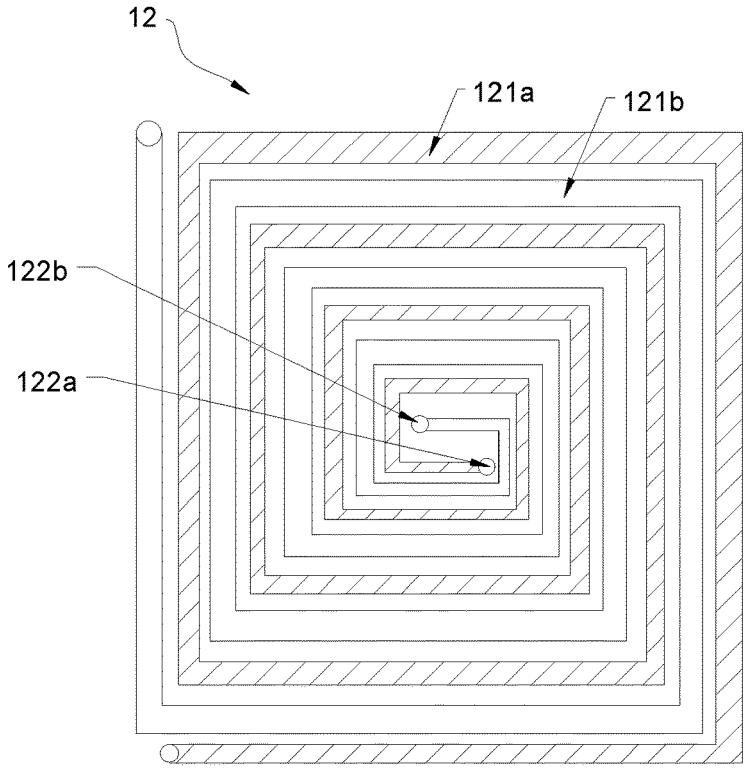
FIG. 3 is a schematic top view of a switch trace layer in the membrane switch according to the first embodiment of the present disclosure.

Specifically, referring to FIG. 3, the switch trace layer 12 is a copper foil trace pattern etched on a surface of the flexible substrate. The copper foil trace pattern includes a pair of meandering-shaped copper foil traces 121*a* and 121*b* that are not in contact with each other and perpendicular to each other, and rounded outward. The meandering-shaped copper foil trace 121*a* is provided with at least one conductive contact 122*a*, and the meandering-shaped copper foil trace 121*b* is provided with at least one conductive contact 122*b*. The number of conductive contacts disposed on the meandering-shaped copper foil trace 121*a* is consistent with the number of conductive contacts disposed in the meandering-shaped copper foil trace 121*b*. As illustrated in FIG. 3, the meandering-shaped copper foil trace 121*a* is provided with one conductive contact 122*a*, and the meandering-shaped copper foil trace 121*b* is provided with one conductive contact 122*b*. In response to being pressed, the conductor 3 is in contact with both the conductive contact 122*a* and the conductive contact 122*b*, such that these two conductive contacts are electrically conducted.

In practice, the two meandering-shaped copper foil traces 121*a* and 121*b* may be respectively configured as a positive pole trace and a negative pole trace. In the case that the flexible key 2 is not pressed, since the two meandering-shaped copper foil traces 121*a* and 121*b* are not in contact with each other, the positive pole trace and the negative pole trace are in a non-conducted state. In the case that the flexible key 2 is pressed, the conductor is shifted downward under the pressing, and is in contact with the conductive contacts 122*a* and 122*b*, such that the conductive contacts 122*a* and 122*b* are connected. In this way, the positive pole trace and the negative pole trace are conducted. In the case that the conductive contacts 122*a* and 122*b* on the two meandering-shaped copper foil traces 121*a* and 121*b* are connected via the conductor 3, the positive pole trace and the negative pole trace are simultaneously conducted, such that a key press signal is generated.

The copper foil trace pattern is fabricated on the flexible substrate by etching, which, as compared with the traditional printed silver slurry trace, more accommodates rigid environments. In addition, since the etching has a high precision, a width and a pitch of the fabricated copper foil traces are greatly reduced as compared with the printing (that is, the traces are finer), such that the two meandering-shaped copper foil traces are arranged more densely on the premise of not being in contact with each other. That is, the two meandering-shaped copper foil traces have a smaller gap therebetween. In this way, in the case that the conductor is abutted against the copper foil trace pattern, the higher the probability that the conductor is in contact with the two meandering-shaped copper foil traces simultaneously, the higher the probability that the conductive contacts on the two meandering-shaped copper foil traces are conducted, and hence the more simply the two meandering-shaped copper foil traces are conducted.

In practical fabrication, the flexible substrate 11 may be made of a polyimide or polyester film as a base material. Since the polyimide or polyester film has excellent high and low temperature resistance and tensile strength, the flexible substrate fabricated using the polyimide or polyester film has better flexibility, and thus is applicable to products imposing a flexibility requirement.

In this embodiment, referring to FIG. 1 and FIG. 2, the flexible key 2 includes a key body 22 fixedly connected to the flexible substrate 11, wherein a press cavity 21 is defined between the key body 22 and the flexible substrate 11. A middle inner wall of the key body 22 extends downward to form a key contact 23 right over each of the contacts 122*a* and 122*b* of the switch trace layer 12. In the case that a position, corresponding to the key contact 23, of the key body 22 is pressed, the key body 22 is deformed to press and drive the key contact 23 to move toward the switch trace layer 12. In practical operation, an edge of the flexible key 2 may be bonded to the flexible substrate 11 via an adhesive (for example, a UV adhesive).

The conductor 3 is a metal snap dome disposed between the switch trace layer 12 and the key contact 23, wherein an edge of the metal snap dome is fixedly connected to the flexible substrate 11 by a waterproof adhesive (for example, a UV adhesive). In the course that the key contact 23 moves toward the switch trace layer 12, the key contact 23 is pressed against the metal snap dome, and drives the metal snap dome to be deformed and down-shifted, and in contact with the conductive contacts 122*a* and 122*b* of the switch trace layer 12. In this way, the switch trace layer 12 is conducted, and hence the key press signal is generated.

In this embodiment, the metal snap dome is employed as the conductor, which not only implements the electricity conduction function, but also implements the press-induced rebounding function of the elastic sheet. This is equivalent to integrating the conductor and the elastic sheet as a single body, and thus saves the parts. In addition, during pressing, strong mechanical tapping sound is generated, which accommodates requirements of some users on a strong tapping feeling. In addition, by fixedly connecting the edge of the metal snap dome to the flexible substrate by the UV adhesive, in one aspect, the metal snap dome is fixed; and in another aspect, a closed space is formed inside the metal snap dome, which effectively blocks the moisture, and prevents the moisture from entering the switch trace layer and thus causing oxidation of the switch trace layer.

According to the present disclosure, the circuit board and the isolation layer in the related art are canceled, and the switch trace layer having the functionality of a switch circuit is directly integrated on a flexible substrate. That is, the original three-layer structure (an upper circuit board, an isolation layer, and a lower circuit board) are integrated as a one-layer structure (the flexible substrate), and the trace on the upper circuit board and the trace on the lower circuit board are integrated as one switch trace layer. In this way, an overall thickness of the membrane switch is reduced and the weight of the membrane switch is lowered. The flexible key presses the metal snap dome to cause the metal snap dome to be in contact with the conductive contacts on the switch trace layer, such that the two meandering-shaped copper foil traces on the switch trace layer are conducted, and hence the key press signal is generated.

In this embodiment, a front surface and a back surface of the flexible substrate 11 are also each coated with an insulative black adhesive layer. The insulative black adhesive layer is provided with through holes corresponding to the conductive contacts 122*a* and 122*b*. Coating the insulative black adhesive layer may mitigate oxidation caused in the case that the copper foil trace pattern is in direct contact with air.

Second Embodiment

In this embodiment, a light-emitting assembly is additionally configured based on the first embodiment to achieve a light emitting function of the membrane switch.

Figure 4:
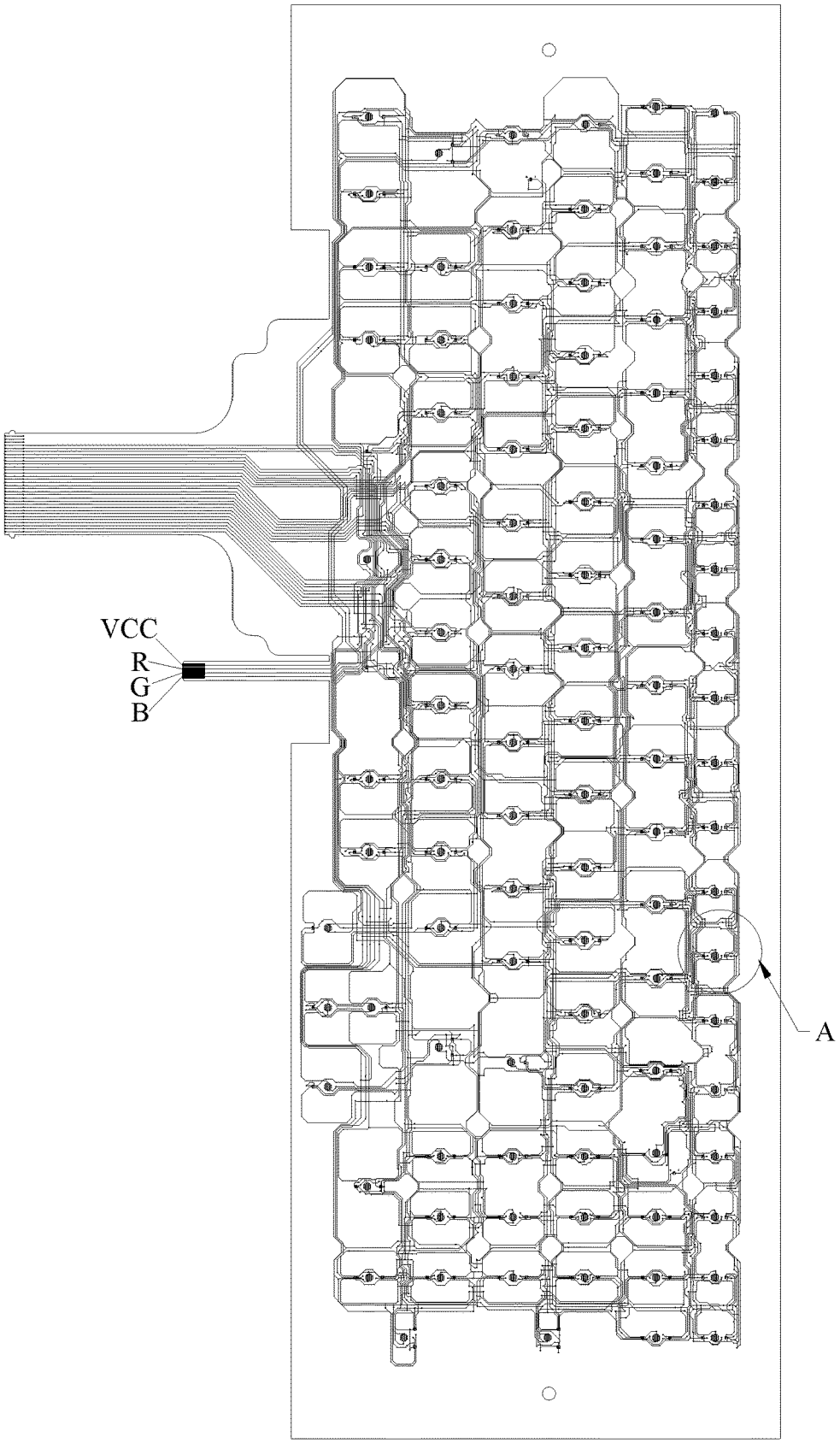
FIG. 4 is a schematic circuit diagram of a membrane switch according to a second embodiment of the present disclosure.
Figure 5:
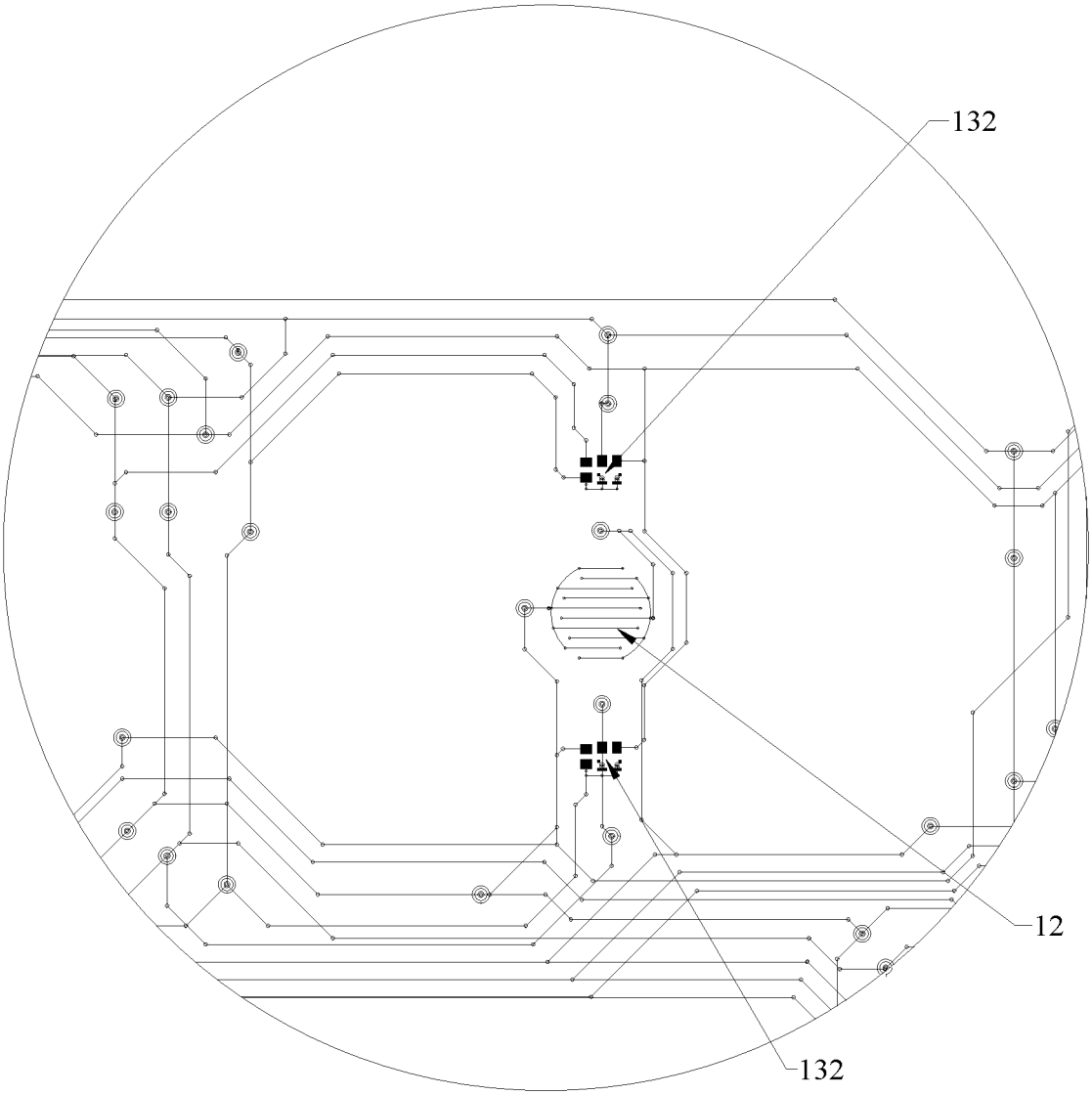
FIG. 5 is a partial enlarged view of part A in FIG. 4.
Figure 6:
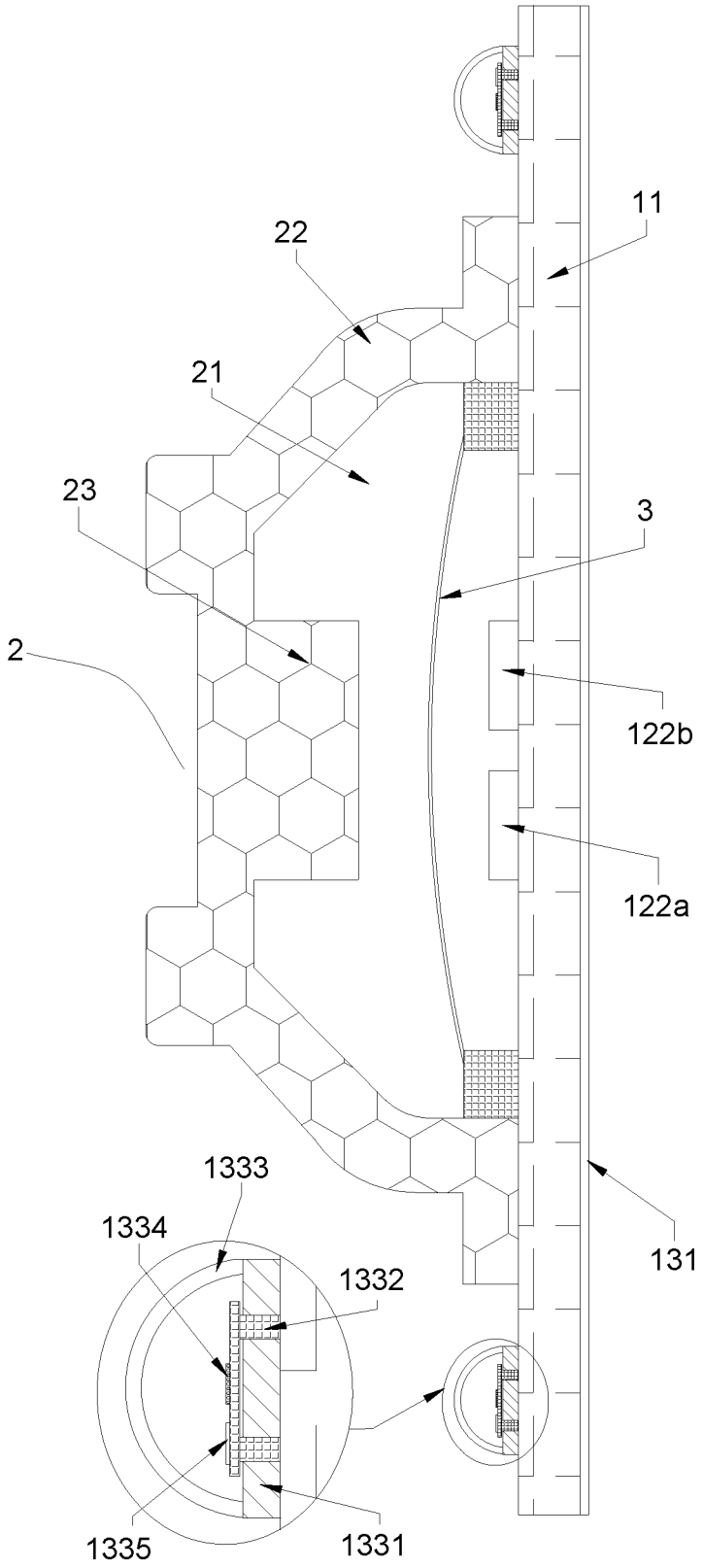
FIG. 6 is a schematic structural view of the membrane switch according to the second embodiment of the present disclosure.

Specifically, as illustrated in FIGS. 4 to 6, the light-emitting assembly includes a light-emitting circuit 131 integrated on the back surface of the flexible substrate 11, and a plurality of sites 132 conducted to the light-emitting circuit 131 are disposed on the front surface of the flexible substrate 11. The sites 132 are disposed on the same side as the switch trace layer 12, and are disposed on an outer side of the flexible key 2 to weld the built-in drive IC-mounted LED 133. By configuring the built-in drive IC in the LED 133, the corresponding LED is controlled independently by a single built-in drive IC, such that it is convenient to control the individual key to emit light.

The built-in drive IC-mounted LED has the following structure:

Referring to FIG. 6, the built-in drive IC-mounted LED 133 includes an insulative body 1331, a conductive terminal 1332, a built-in drive IC 1335, a light-emitting chip 1334, and a light transmissive cap 1333. The insulative body 1331 is fixedly connected to the flexible substrate 11 disposed on the outer side of the flexible key 2, and the conductive terminal 1332 conducted to the site 132 is disposed on the insulative body 1331. The built-in drive IC 1335 and the light-emitting chip 1334 are both welded and fixed to the conductive terminal 1332, and the built-in drive IC 1335 and the light-emitting chip 1334 are electrically connected via a conductive wire. The light-transmissive cap 1333 covers the insulative body 1331, and two ends of the light-transmissive cap 1333 is fixed to the insulative body 1332 by snap-fitting or threading. The built-in drive IC 1335 and the light-emitting chip 1334 are both disposed in the light-transmissive cap 1333.

The conductive terminal 1332 includes a plurality of conductive bumps embedded inside the insulative body 1331, and the insulative body 1331 extends out from lower ends of the conductive bumps and is in electrical contact with the sites 132. The insulative body 1331 extends out from upper ends of the plurality of conductive bumps, and the insulative body and the upper ends are collectively connected to a conductive pad. The built-in drive IC 1335 and the light-emitting chip 1334 are both fixedly connected to the conductive pad.

The built-in drive IC 1335 is disposed inside the light-transmissive cap 1333, and the built-in drive IC 1335 and the light-emitting chip 1334 are directly electrically connected via a conductive wire, such that the built-in drive IC 1335 and the light-emitting chip 1334 are integrated. In this way, the single built-in drive IC 1335 independently controls the individual LED to emit light, and further, by disposing the built-in drive IC inside the light-transmissive cap, the space for accommodating an additionally configured IC control module is saved, and production of small and lightweight products is facilitated. In addition, in the light-transmissive cap 1333, the built-in drive IC 1335 and the light-emitting chip 1334 are directly connected via the conductive wire, such that the light-emitting chip 1334 more stably and reliably emits light.

In this embodiment, the light-transmissive cap 1333 may be made of an epoxy resin. The epoxy resin has the merits of high light transmittance, high refractive index, good heat resistance, wet-resistance, insulation performance, high mechanical strength, and chemical stability, and thus not only implements the light transmission function, but also achieves good insulation and protection performance.

Based on the first embodiment, in this embodiment, the light-emitting layer is directly integrated on the flexible substrate, such that the overall thickness of the membrane switch is effectively reduced. In addition, by the built-in drive IC-mounted LED, a built-in drive IC is internally configured in the LED. In this way, the single LED is independently controlled, and further the mounting space for additionally mounting an IC control module is saved, such that the light-emitting assembly is more compact and has a smaller thickness.

Third Embodiment

The first and second embodiments both employ the metal snap dome as the conductor of the membrane switch, and during pressing, a great metal tapping feeling is created. However, in practice, some users may desire muted pressing. To accommodate customized requirements of some users, this embodiment makes some improvements on the membrane switch according to the first or second embodiment. The membrane switch in this embodiment is different from that in the first or the second embodiment in that: The metal snap dome is replaced with a silicone elastic sheet, and a conductive silver slurry is coated on the silicone elastic sheet as the conductor.

Figure 7:
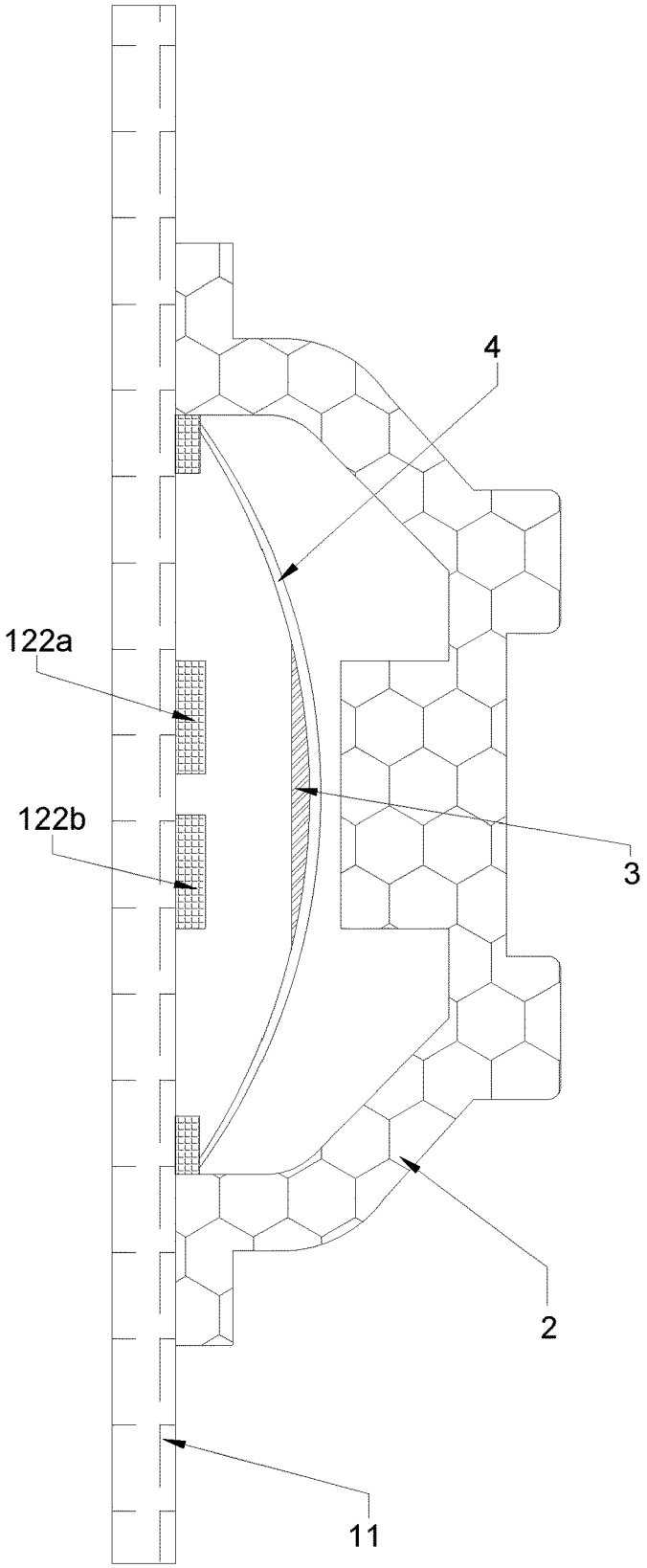
FIG. 7 is a schematic structural view of a membrane switch, modified based on the first embodiment, according to a third embodiment of the present disclosure.
Figure 8:
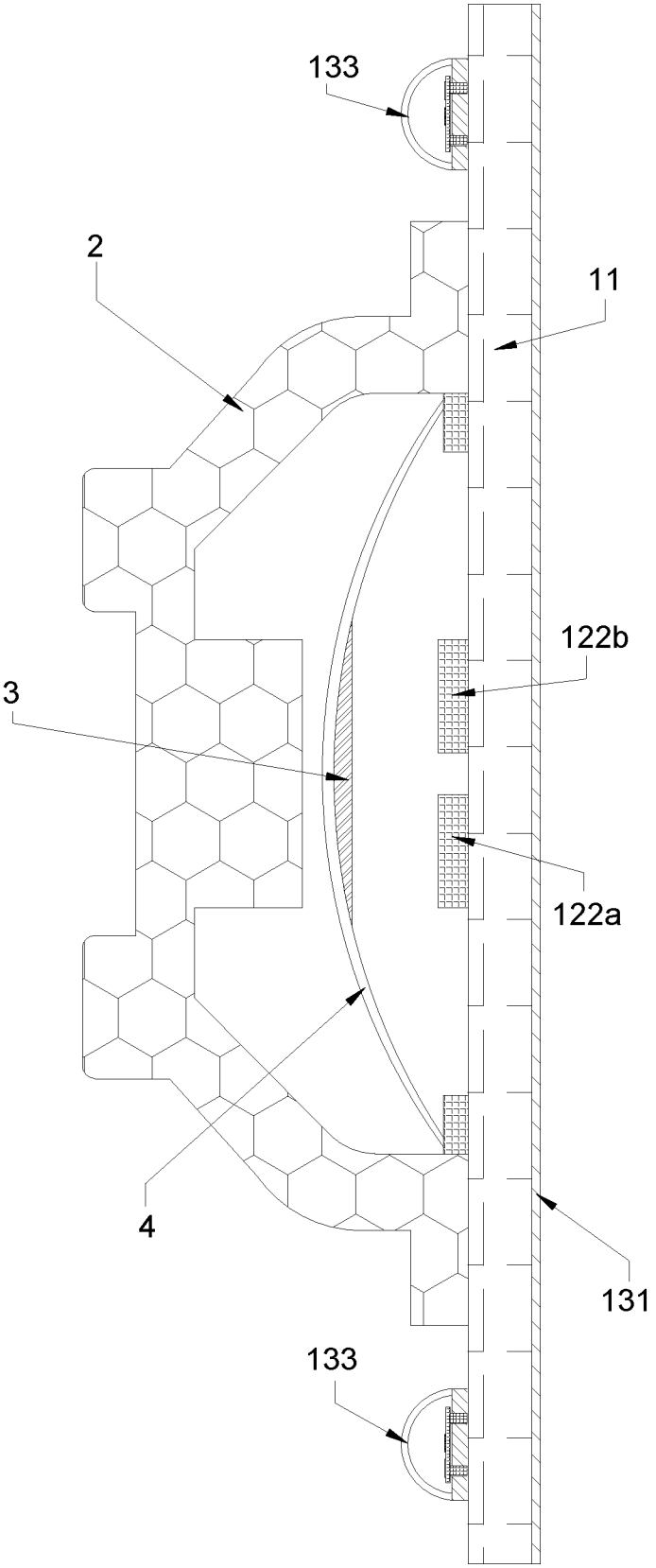
FIG. 8 is a schematic structural view of a membrane switch, modified based on the second embodiment, according to a third embodiment of the present disclosure.

Specifically, referring to FIG. 7 and FIG. 8 (FIG. 7 illustrates some improvements on the membrane switch as a prototype according to the first embodiment, and FIG. 8 illustrates some improvements on the membrane switch as a prototype according to the second embodiment), a silicone elastic sheet 4 covering the switch trace layer 12 is disposed in the press cavity 21. An edge of the silicone elastic sheet 4 is fixedly connected to the flexible substrate 11 via a waterproof adhesive (for example, a UV adhesive). The conductor 3 is a conductive silver slurry coated on an inner wall of the silicone elastic sheet 4; wherein the conductive silver slurry is coated right above the switch trace layer 12. In the case that the flexible key 2 is pressed, the flexible key 2 is abutted against the silicone elastic sheet 4, and drives the silicone elastic sheet 4 to be deformed and in contact with the switch trace layer 12, such that the switch trace layer 12 is conducted.

As compared with the metal snap dome, the silicone elastic sheet has a better press elasticity, achieves a better touch sensation, and produces an extremely small sound during pressing, such that the requirement of muted pressing of the user is accommodated. By directly disposing the conductor (the conductive silver slurry) on the silicone elastic sheet, the mounting space of the conductor is saved, and the force applied to the silicone elastic sheet is directly transferred to the conductive silver slurry, such that loss of the pressing force is reduced.

Fourth Embodiment

During test of the membrane switch, the applicant has found that in the third embodiment, by directly coating the conductive silver slurry on the inner wall of the silicone elastic sheet 4, wear resistance of the silicone elastic sheet 4 may be degraded, which directly shortens the lifetime of the silicone elastic sheet 4. Therefore, in this embodiment, some improvements are made to the mounting position and mounting fashion of the conductor in the third embodiment. This embodiment is different from the third embodiment in that the conductor 3 is isolated from the silicone elastic sheet 4.

Figure 9:
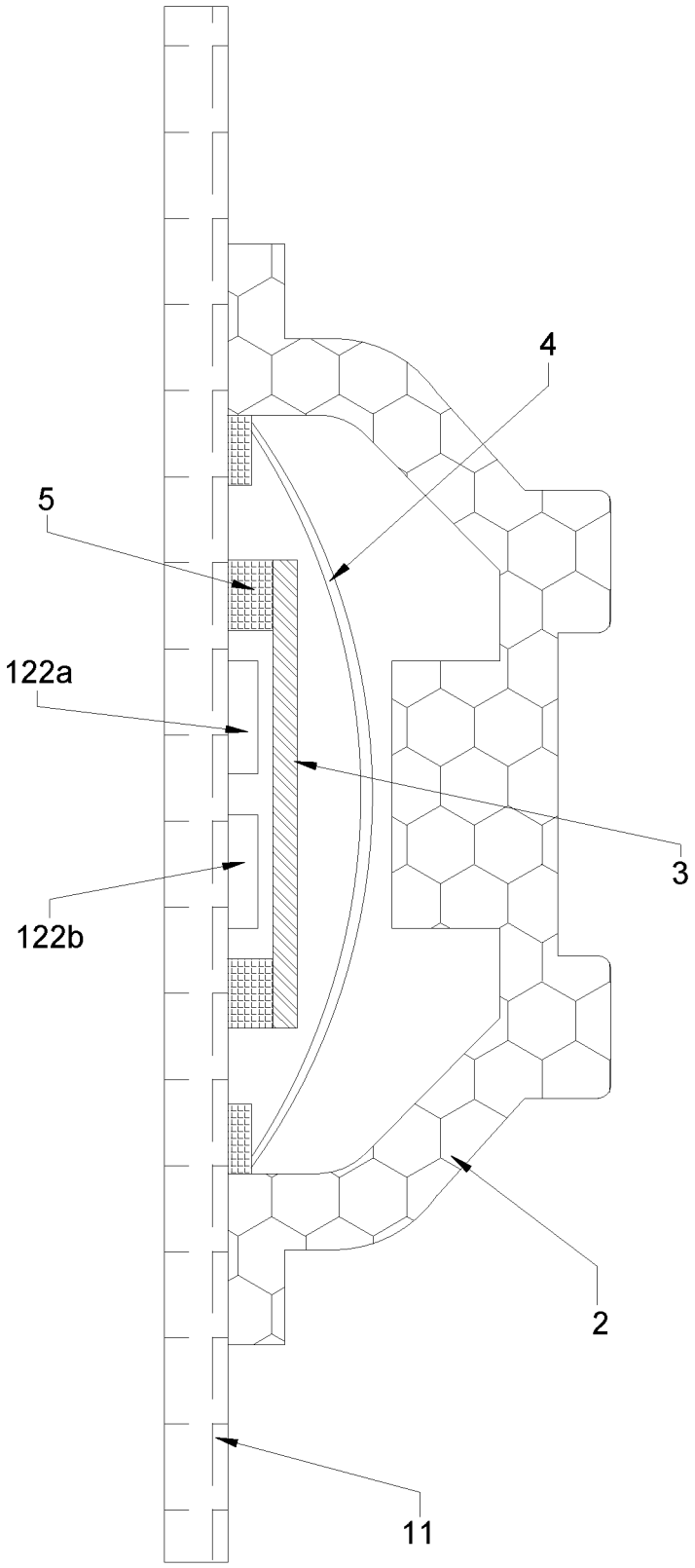
FIG. 9 is a schematic structural view of a membrane switch, prototyped on the membrane switch according to the first embodiment, according to a fourth embodiment of the present disclosure.
Figure 10:
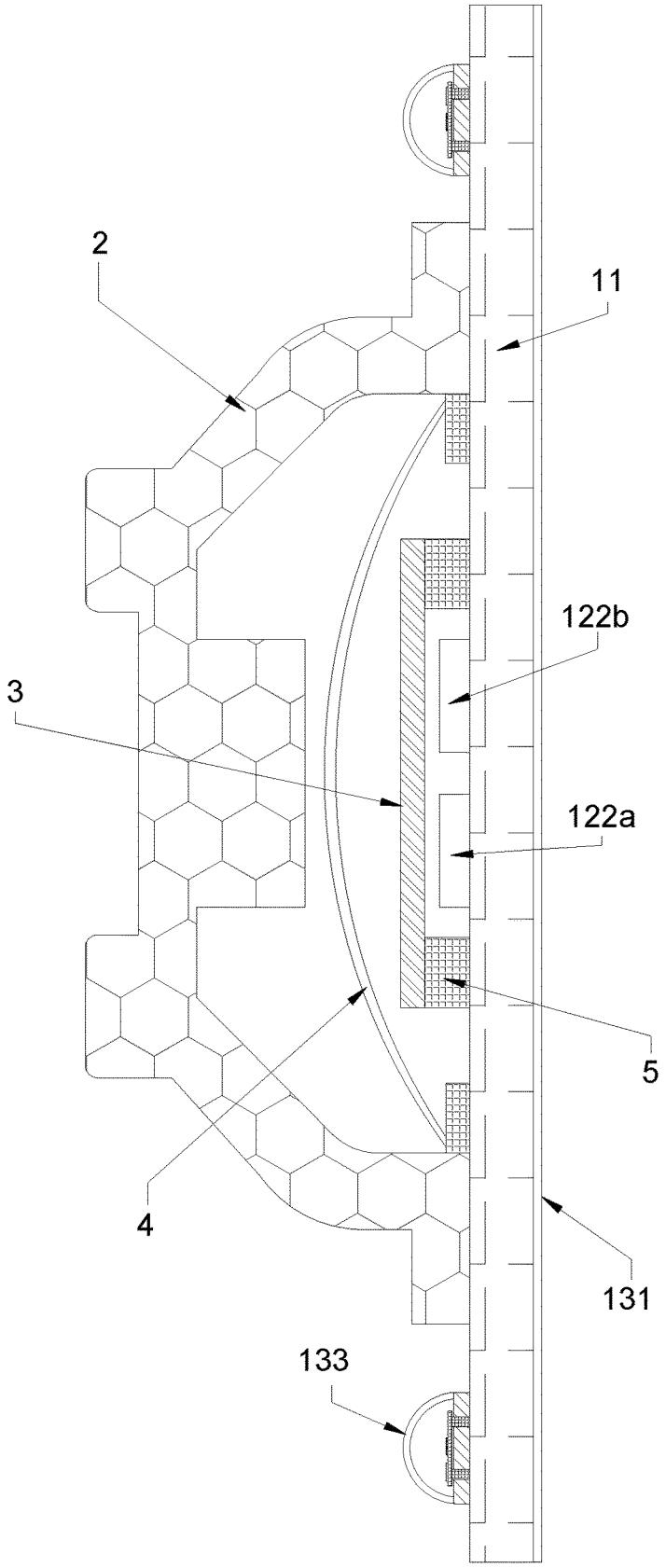
FIG. 10 is a schematic structural view of a membrane switch, prototyped on the membrane switch according to the second embodiment, according to the fourth embodiment of the present disclosure.

Specifically, referring to FIG. 9 and FIG. 10 (FIG. 9 illustrates some improvements on the membrane switch as a prototype according to the first embodiment, and FIG. 10 illustrates some improvements on the membrane switch as a prototype according to the second embodiment), a silicone elastic sheet 4 covering the switch trace layer 12 is disposed in the press cavity 21. An edge of the silicone elastic sheet 4 is fixedly connected to the flexible substrate 11 via a waterproof adhesive (for example, a UV adhesive), and hence a cavity is formed. The cavity of the silicone elastic sheet 4 is internally provided with an insulative layer 5 surrounding the outer side of the switch trace layer 12. A lower end of the insulative layer 5 is fixedly connected to the flexible substrate 11, and an upper end face of the insulative layer 5 is higher than the upper end face of the switch trace layer 12. The insulative layer 5 may employ a closed annular or square structure, or other closed structures. Exemplarily, a height of the insulative layer 5 is set to 3 μm. In practical design, the height of the insulative layer 5 may be set to 2 to 4 μm according to actual needs. The conductor 3 is fixed to the upper end face of the insulative layer 5, and a press gap is defined between the conductor 3 and the silicone elastic sheet 4. The insulative layer 5 is made of a UV adhesive or other insulative materials. The conductor 3 is made of a flat-type conductive material.

Configuration of the press gap causes the silicone elastic sheet 4 to be separated from the conductor 3, such that the problem that degradation of the wear resistance caused by directly integrating the conductor 3 on the silicone elastic sheet 4 is prevented. With configuration of the insulative layer 5, an isolation gap is defined between the conductor 3 and the switch trace layer 12, such that the conductor 3 in the non-pressing state is prevented from being in direct contact with the switch trace layer 12. In addition, use of the UV adhesive as the insulative layer 5 not only achieves bonding and fixing of the conductor, but also achieves a waterproof effect. In the case that the flexible key 2 is pressed, the flexible key 2 is abutted against the silicone elastic sheet 4, and drives the silicone elastic sheet 4 to be deformed and pressed against the conductor 3, and the conductor 3 is down-shifted accordingly and in contact with the switch trace layer 12 disposed inside the insulative layer 5, such that the switch trace layer 12 is conducted.

As compared with the third embodiment, in this embodiment, the membrane switch effectively improves the lifetime of the silicone elastic sheet while ensuring muted pressing. In this way, a requirement imposed by the user on the number of tapping times of the membrane switch is accommodated.

Figure 11:
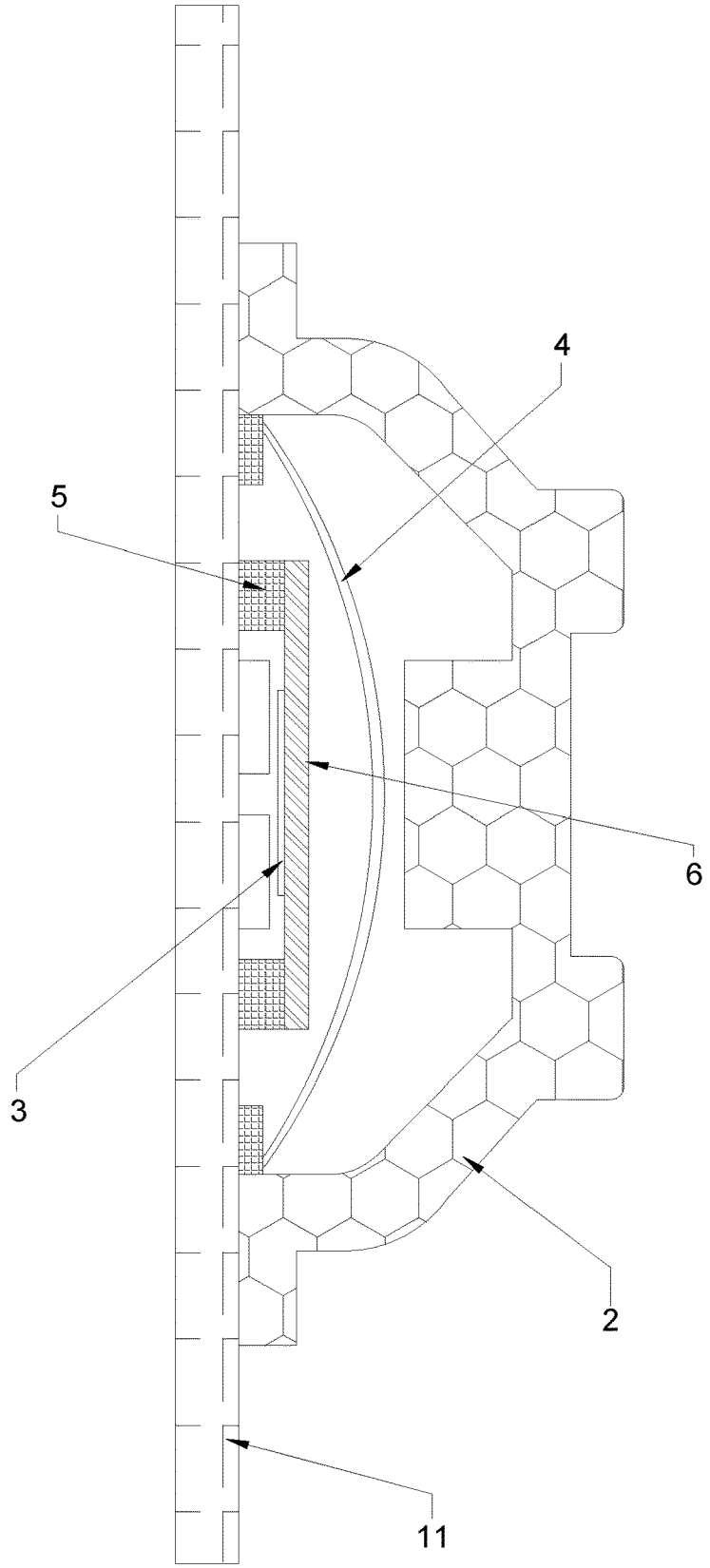
FIG. 11 is a schematic structural view of another membrane switch, prototyped on the membrane switch according to the first embodiment, according to an embodiment of the present disclosure.
Figure 12:
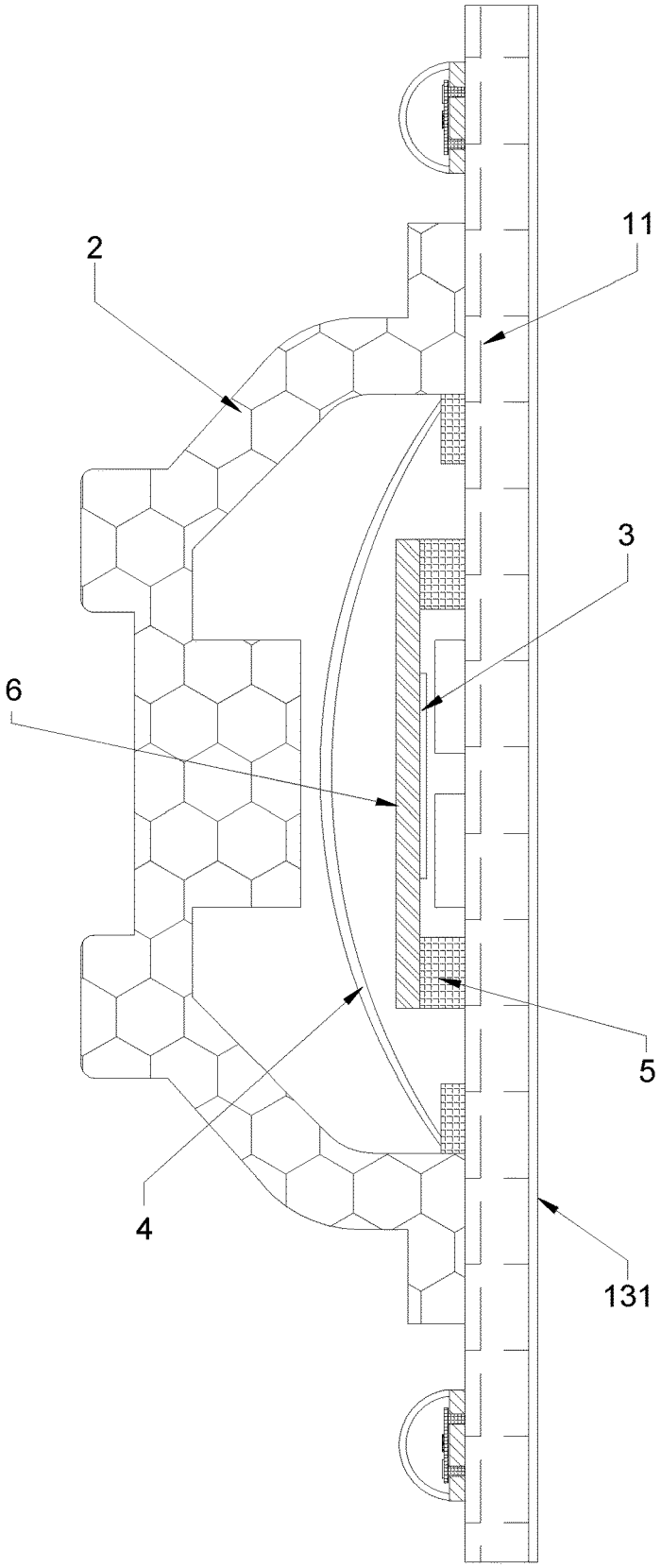
FIG. 12 is a schematic structural view of another membrane switch, prototyped on the membrane switch according to the second embodiment, according to an embodiment of the present disclosure.

As another solution of this embodiment, referring to FIG. 11 and FIG. 12 (FIG. 11 illustrates some improvements on the membrane switch as a prototype according to the first embodiment, and FIG. 12 illustrates some improvements of the membrane switch as a prototype according to the second embodiment), the conductor 3 is not directly mounted on the upper end face of the insulative layer 5, and instead, a PET flat plate 6 is mounted on the upper end face of the insulative layer 5 and a conductive silver slurry is coated on a lower end face of the PET flat plate 6 as the conductor 3. The PET flat plate is a polyester plate.

Fifth Embodiment

Since in the switch trace layer according to the present disclosure, the positive and negative pole traces are integrated on one flexible substrate, where trace oxidation occurs in the switch trace layer due to invasion of moisture, the positive and negative pole traces of the switch trace layer on the same switch trace layer may be easily subject to oxidation and damage, causing failure of the plurality of conductive contacts. Therefore, this embodiments makes some improvements on the waterproof performance of the membrane switch.

This embodiment is different from the fourth embodiment in that the height of the insulative layer 5 is 8 to 12 μm.

Figure 13:
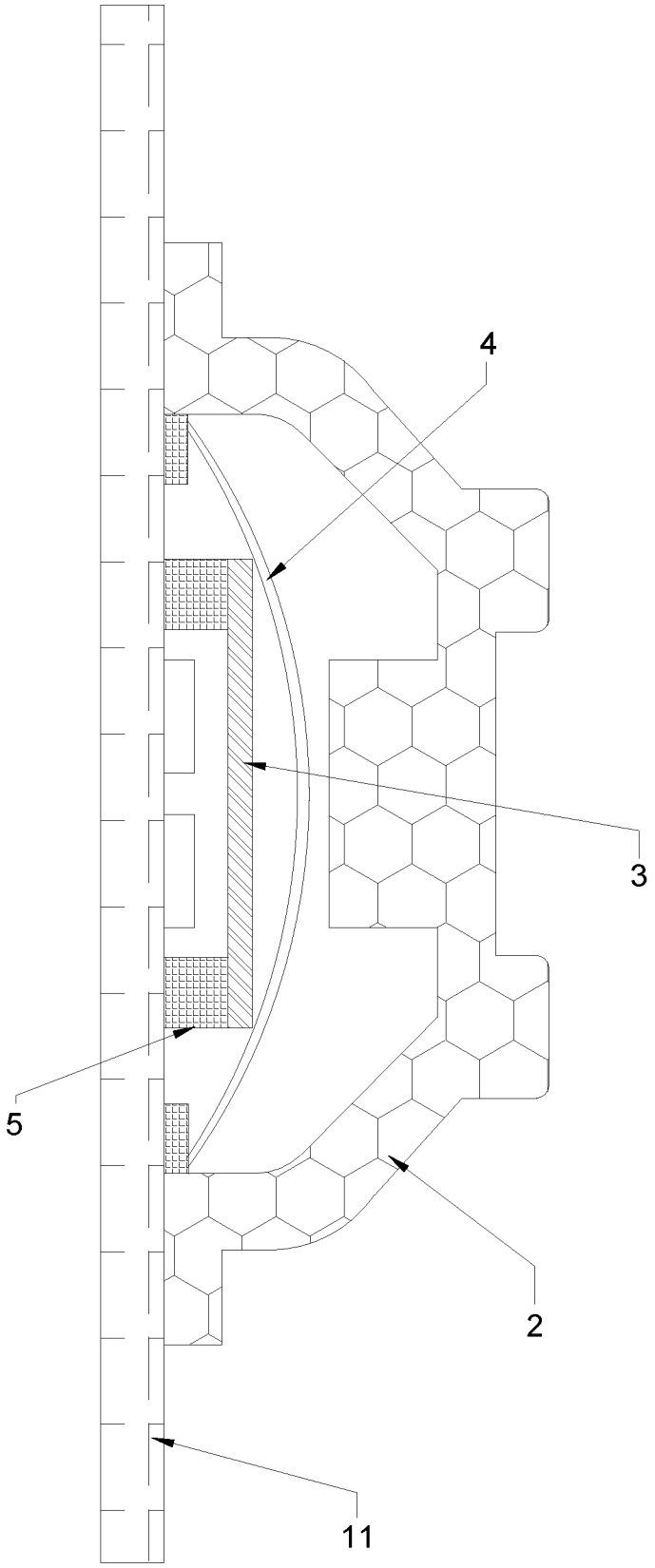
FIG. 13 is a schematic structural view of a membrane switch, prototyped on the membrane switch according to the first embodiment, according to a fifth embodiment of the present disclosure.
Figure 14:
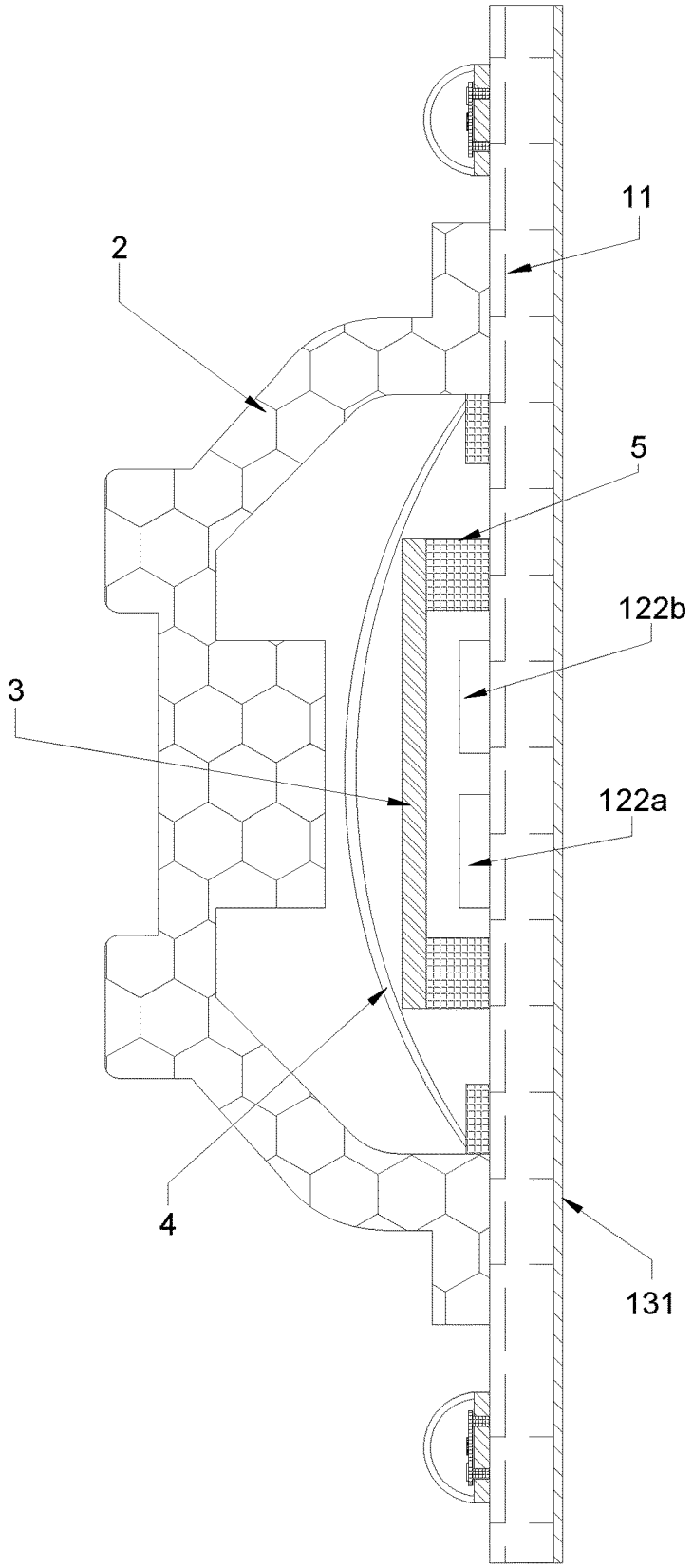
FIG. 14 is a schematic structural view of a membrane switch, prototyped on the membrane switch according to the second embodiment, according to the fifth embodiment of the present disclosure.

Specifically, referring to FIG. 13 and FIG. 14 (FIG. 13 illustrates some improvements on the membrane switch as a prototype according to the first embodiment, and FIG. 14 illustrates some improvements on the membrane switch as a prototype according to the second embodiment), in this embodiment, the height of the insulative layer 5 is directly increased to 10 μm, such that the insulative layer 5 forms a barrier enclosing the switch trace layer 12, thereby achieving enhancing the waterproof performance. Where the moisture invades the flexible substrate and is spread thereon, since the insulative layer 5 is higher, the insulative layer may block the moisture. In the case that the moisture moves toward the switch trace layer 12, since the insulative layer surrounding the outer side of the switch trace layer 12 forms an annular barrier similar to a dam to block the moisture out of the insulative layer 5, erosion by the moisture to the switch trace layer is prevented. It should be noted that, for enhancement of the waterproof performance, the height of the insulative layer is not limited to 10 μm, and the designer may set the height to 8 to 12 μm according to actual design needs.

Sixth Embodiment

During test of the membrane switch, the applicant has found that in the membrane switch according to the fifth embodiment, since a difference between the height of the insulative layer and the height of the switch trace layer is great, the user may obviously feel a hard press septation when pressing the membrane switch. Therefore, based on the fifth embodiment, this embodiment cancels the insulative layer having the waterproof function in the fourth embodiment, still sets the height of the insulative layer to 2 to 4 μm, and configures a waterproof structure on the outer side of the flexible key.

Figure 15:
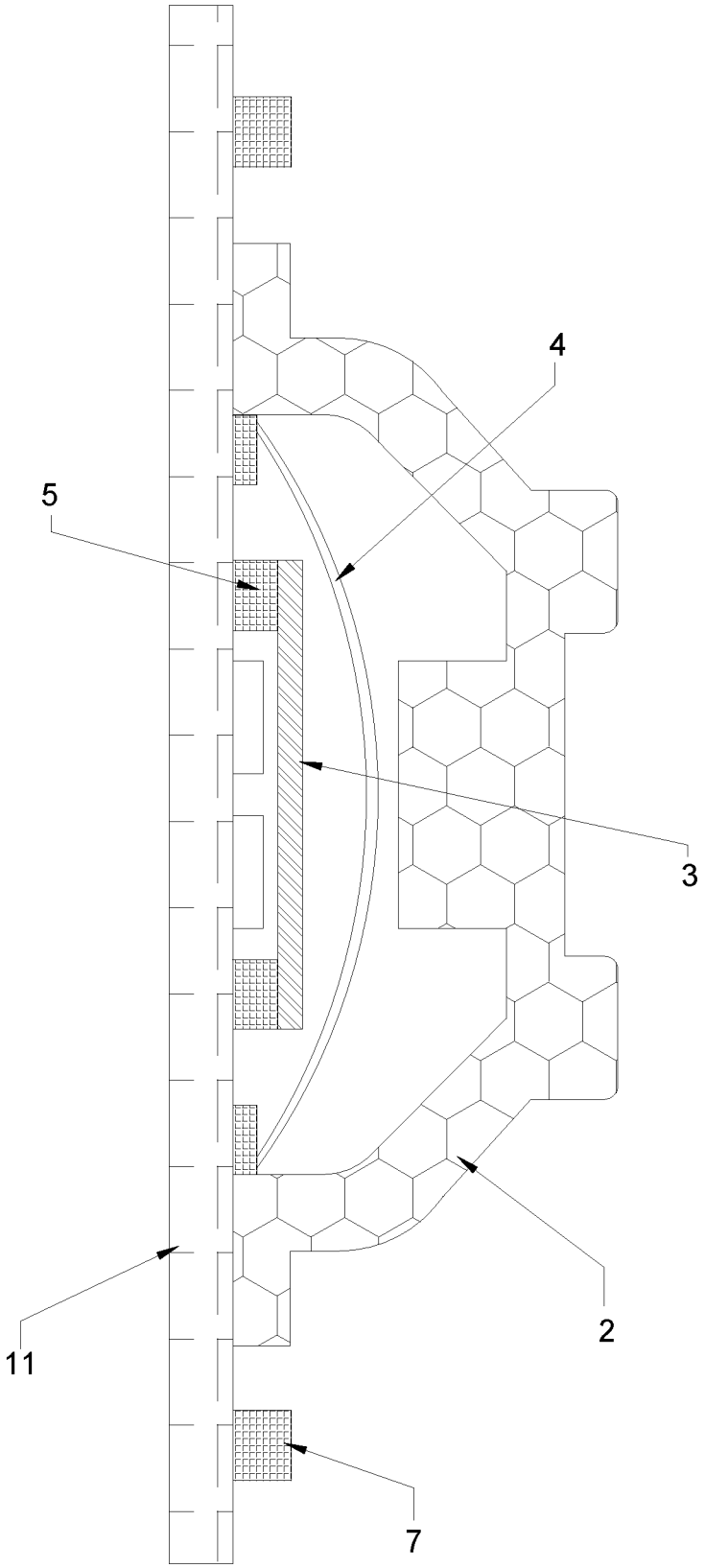
FIG. 15 is a schematic structural view of a membrane switch, prototyped on the membrane switch according to the first embodiment, according to a sixth embodiment of the present disclosure.
Figure 16:
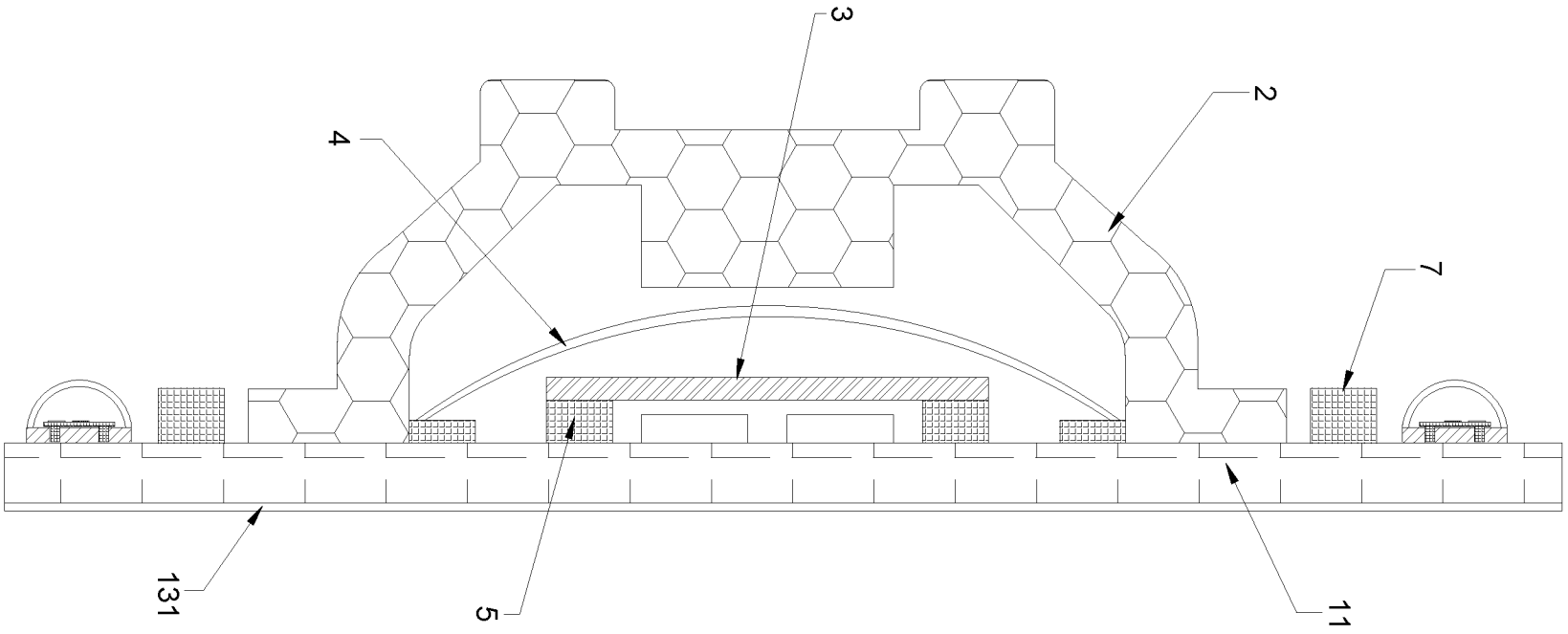
FIG. 16 is a schematic structural view of a membrane switch, prototyped on the membrane switch according to the second embodiment, according to the sixth embodiment of the present disclosure.

Since the height of the insulative layer is set to 2 to 4 μm, and the insulative layer is only slightly higher than the switch trace layer, the insulative layer achieves a limited waterproof effect for the switch trace layer, and thus the moisture may easily enter the inside of the insulative layer, thereby causing erosion to the switch trace layer in the insulative layer. Therefore, referring to FIG. 15 and FIG. 16 (FIG. 15 illustrates some improvements on the membrane switch as a prototype according to the first embodiment, and FIG. 16 illustrates some improvements on the membrane switch as a prototype according to the second embodiment), in this embodiment, the waterproof structure is a waterproof layer surrounding the outer side of the flexible key 2. A lower end of the waterproof layer 7 is fixedly connected to the flexible substrate 11, and an upper end face of the waterproof layer 7 is higher than the upper end face of the switch trace layer 12. The height of the waterproof layer 7 is 8 to 12 μm. The waterproof layer 7 is in a closed annular structure to totally surround the flexible key 2. The waterproof layer 7 is a UV adhesive layer. By additionally configuring the waterproof layer on the outer side of the flexible key, the moisture is blocked from the outer side of the flexible key, and thus the moisture is prevented from entering the inside of the flexible key. In this way, waterproof protection is achieved from the entire flexible key is achieved, and with configuration of the waterproof layer on the outer side of the flexible key, the sensation on pressing the flexible key is not affected by the height of the waterproof layer.

In the case that the moisture is spread on the flexible substrate 11, due to blocking by the waterproof layer 7, the moisture is blocked out of the waterproof layer 7, such that the moisture is blocked from entering the flexible key 2, thereby achieving a waterproof and protection effect on the switch trace layer 12 inside the flexible key 2.

Seventh Embodiment

Figure 17:
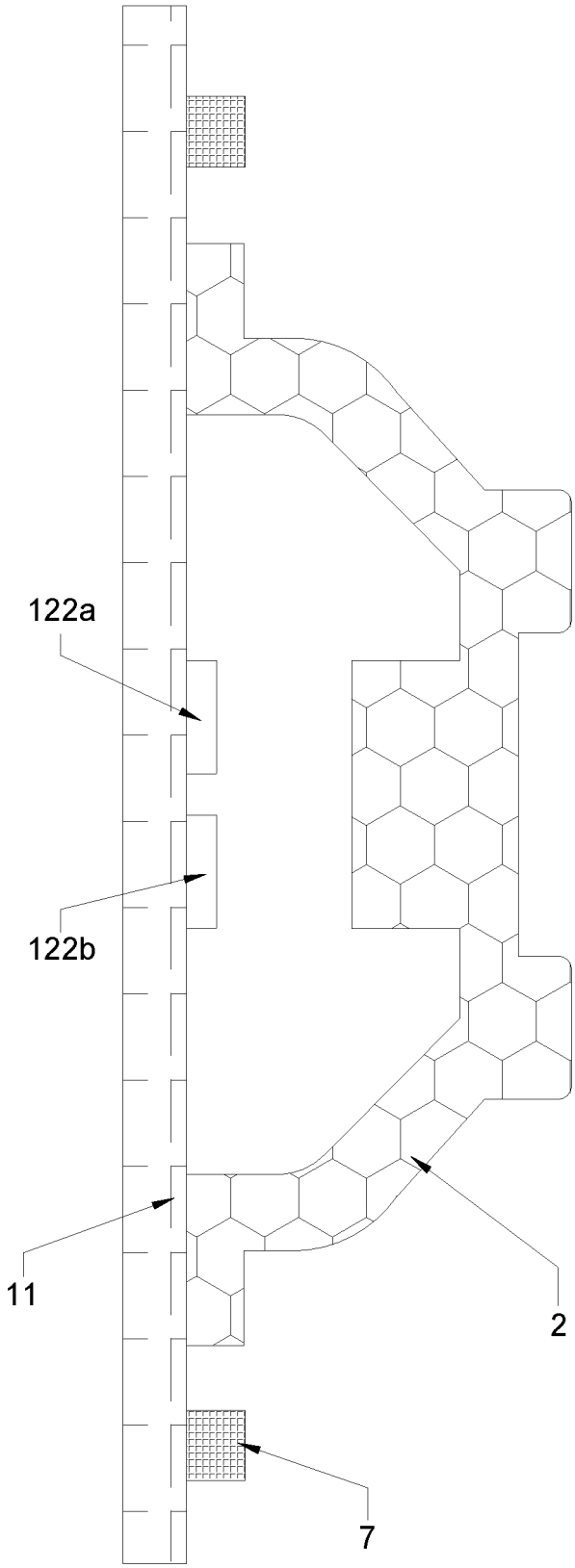
FIG. 17 is a schematic structural view of a membrane switch, prototyped on the membrane switch according to the first embodiment, according to a seventh embodiment of the present disclosure.
Figure 18:
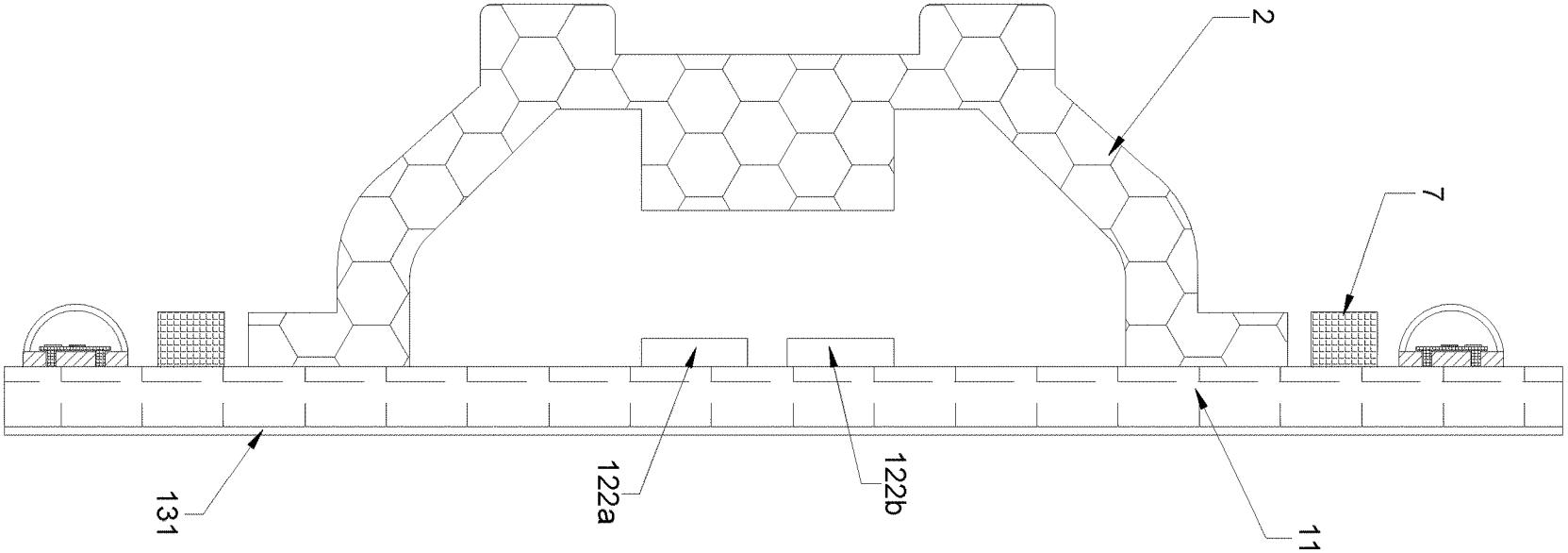
FIG. 18 is a schematic structural view of a membrane switch, prototyped on the membrane switch according to the second embodiment, according to the seventh embodiment of the present disclosure.

This embodiment is different from any of the first to third embodiments in that: A waterproof structure is additionally configured. Referring to FIG. 17 and FIG. 18 (FIG. 17 illustrates some improvements on the membrane switch as a prototype according to the first embodiment, and FIG. 18 illustrates some improvements on the membrane switch as a prototype according to the second embodiment), the waterproof structure is a waterproof layer surrounding the outer side of the flexible key 2. A lower end of the waterproof layer 7 is fixedly connected to the flexible substrate 11, and an upper end face of the waterproof layer 7 is higher than the upper end face of the switch trace layer 12. The height of the waterproof layer 7 is not less than 8 μm. The waterproof layer 7 is a UV adhesive layer. The waterproof layer 7 is in a closed annular structure to totally surround the flexible key.

In the case that the moisture is spread on the flexible substrate 11, due to blocking by the waterproof layer 7, the moisture is blocked out of the waterproof layer 7, such that the moisture is blocked from entering the flexible key 2, thereby achieving a waterproof and protection effect on the switch trace layer 12 inside the flexible key 2.

Eighth Embodiment

This embodiment is different from any of the first to seventh embodiments in that the copper trace pattern is different from those in these embodiments.

Figure 19:
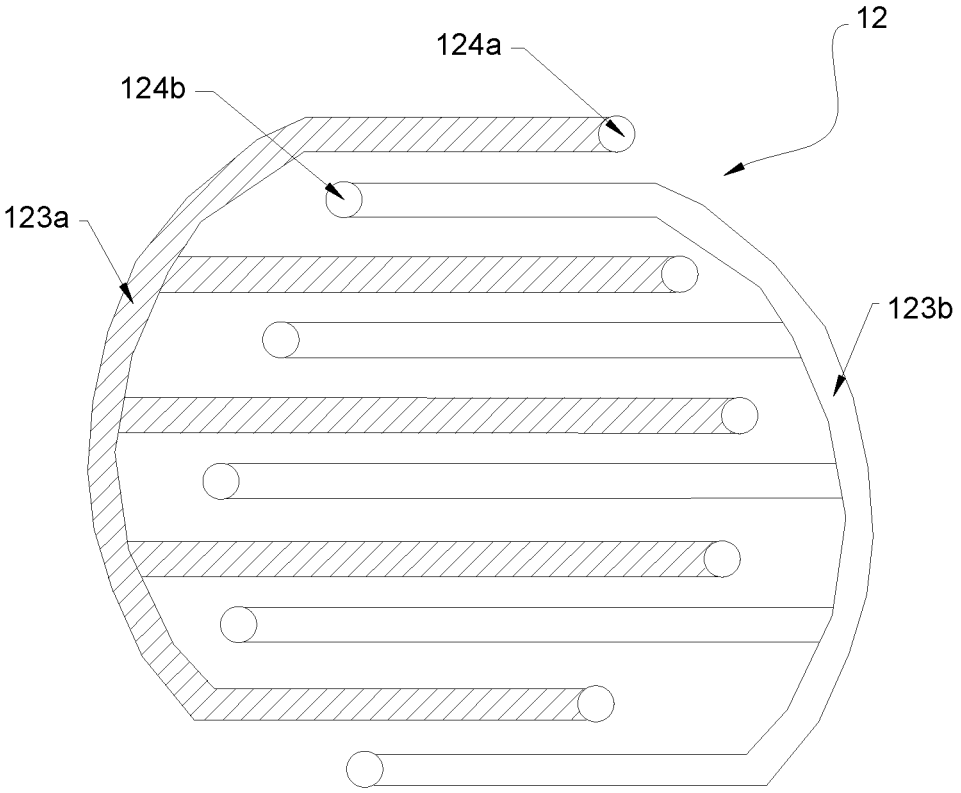
FIG. 19 is a schematic top view of a switch trace layer in the membrane switch according to an eighth embodiment of the present disclosure.

Specifically, referring to FIG. 19, the copper foil trace pattern includes a pair of comb finger-shaped copper foil traces 123*a* and 123*b* that are not in contact with each other and interdigitated. The comb finger-shaped copper foil trace 123*a* is provided with at least one conductive contact 124*a*, and the comb finger-shaped copper foil trace 123*b* is provided with at least one conductive contact 124*b*. Exemplarily, the comb finger-shaped copper foil trace 123*a* in FIG. 10 is provided with five conductive contacts 124*a*, and the comb finger-shaped copper foil trace 123*b* is provided with five conductive contacts 124*b*.

In practice, the two comb finger-shaped copper foil traces 123*a* and 123*b* may be respectively configured as a positive pole trace and a negative pole trace. In the case that the flexible key 2 is not pressed, since the two comb finger-shaped copper foil traces 123*a* and 123*b* are not in contact with each other, the positive pole trace and the negative pole trace are in a non-conducted state. In the case that the flexible key 2 is pressed, the conductor is shifted downward under the pressing, and is in contact with the conductive contacts 124*a* and 124*b*, such that the conductive contacts 124*a* and 124*b* are connected. In this way, the positive pole trace and the negative pole trace are conducted. In the case that the conductive contacts 124*a* and 124*b* on the two comb finger-shaped copper foil traces 123*a* and 123*b* are connected via the conductor 3, the positive pole trace and the negative pole trace are simultaneously conducted, such that a key press signal is generated.

In this embodiment, the densely the comb fingers of the two comb finger-shaped copper foil traces are interdigitated, the higher the probability that the conductor 3 is in simultaneous contact with the conductive contacts on the two comb finger-shaped copper foil traces, and the more simply the two traces are conducted.

Ninth Embodiment

This embodiment provides a key equipped with a membrane switch. The key includes the membrane switch according to any of the first to eighth embodiments. The key, relative to the conventional key, has a more compact structure and a smaller thickness, and accommodates the market requirements of lightweight and ultra-thinness.

Tenth Embodiment

This embodiment provides a keyboard equipped with a membrane switch. The keyboard includes a keyboard substrate, wherein the keyboard substrate is provided with a plurality of keys, and each of the key employs the key in the ninth embodiment. The keyboard has a compact structure and a small thickness, and accommodates the market requirements of lightweight and ultra-thinness.

The above embodiments are merely given for illustration of the technical concepts and features of the present disclosure, and are intended to better help persons skilled in the art to understand the content of the present disclosure and practice the technical solutions according to the present disclosure. However, these embodiments are not intended to limit the protection scope of the present disclosure. Any equivalent variations or polishments made within the spirit and essence of the present disclosure shall fall within the projection scope of the present disclosure.

The invention claimed is:

1. A membrane switch, comprising: a flexible substrate; a switch trace layer, disposed on a front surface of the flexible substrate, and comprising a plurality of conductive contacts that not in contact with each other; a flexible key, covering the switch trace layer, and defining a press cavity with the flexible substrate; and a conductor, disposed in the press cavity, and configured to be connected to the plurality of conductive contacts in response to the flexible key being pressed, such that the switch trace layer is conducted; further comprising a light-emitting assembly; wherein the light-emitting assembly is integrated on the flexible substrate and configured to generate a light beam, the light-emitting assembly comprises a light-emitting circuit integrated on a back surface of the flexible substrate, and the front surface of the flexible substrate is provided with a plurality of sites that are conducted to the light-emitting circuit; wherein the plurality of sites surrounding outside the flexible key, and a built-in drive IC-mounted LED is mounted on each of the sites.

2. The membrane switch according to claim 1, wherein the built-in drive IC-mounted LED comprises an insulative body, a conductive terminal, a built-in drive IC, a light-emitting chip, a light-transmissive cap; wherein the insulative body is fixed to the flexible substrate, and provided with a conductive terminal conducted to the site; the built-in drive IC and the light-emitting chip are both fixedly connected to the conductive terminal, and the built-in drive IC and the light-emitting chip are electrically connected via a conductive wire; and the light-transmissive cap covers the built-in drive IC-mounted LED, and fixed to the insulative body.

3. The membrane switch according to claim 1, wherein the conductor is a metal snap dome covering the switch trace layer; wherein an edge of the metal snap dome is fixedly connected to the flexible substrate.

4. The membrane switch according to claim 1, wherein the press cavity is internally provided with a silicone elastic sheet covering the switch trace layer, and the conductor is a conductive silver slurry coated on an inner wall of a side, facing toward the switch trace layer, of the silicone elastic sheet; wherein the conductive silver slurry is coated right above the switch trace layer.

5. The membrane switch according to claim 1, wherein the press cavity is internally provided with a silicone elastic sheet covering the switch trace layer, the silicone elastic sheet is internally provided with an insulative layer surrounding an outer side of the switch trace layer, an upper end face of the insulative layer being higher than an upper end face of the switch trace layer; wherein a press gap is defined between the conductor and the silicone elastic sheet.

6. The membrane switch according to claim 1, wherein the press cavity is internally provided with a silicone elastic sheet covering the switch trace layer, the silicone elastic sheet is internally provided with an insulative layer surrounding an outer side of the switch trace layer, an upper end face of the insulative layer being higher than an upper end face of the switch trace layer; wherein the upper end face of the insulative layer is provided with a PET flat plate, and the conductor is a conductive silver slurry coated on a lower end face, facing towards the switch trace layer, of the PET flat plate.

7. The membrane switch according to claim 5, wherein the insulative layer has a height of 2 to 4 μm or 8 to 12 μm.

8. The membrane switch according to claim 6, wherein the insulative layer has a height of 2 to 4 μm or 8 to 12 μm.

9. The membrane switch according to claim 5, further comprising a waterproof structure; wherein the waterproof structure is a waterproof layer surrounding an outer side of the flexible key, a lower end of the waterproof layer being fixedly connected to the flexible substrate, and an upper end face of the waterproof layer being higher than the upper end face of the switch trace layer.

10. The membrane switch according to claim 6, further comprising a waterproof structure; wherein the waterproof structure is a waterproof layer surrounding an outer side of the flexible key, a lower end of the waterproof layer being fixedly connected to the flexible substrate, and an upper end face of the waterproof layer being higher than the upper end face of the switch trace layer.

11. The membrane switch according to claim 9, wherein the insulative layer has a height of 2 to 4 μm, and the waterproof layer has a height of 8 to 12 μm.

12. The membrane switch according to claim 10, wherein the insulative layer has a height of 2 to 4 μm, and the waterproof layer has a height of 8 to 12 μm.

13. The membrane switch according to claim 3, further comprising a waterproof structure; wherein the waterproof structure is a waterproof layer surrounding an outer side of the flexible key, a lower end of the waterproof layer being fixedly connected to the flexible substrate, and an upper end face of the waterproof layer being higher than the upper end face of the switch trace layer.

14. The membrane switch according to claim 4, further comprising a waterproof structure; wherein the waterproof structure is a waterproof layer surrounding an outer side of the flexible key, a lower end of the waterproof layer being fixedly connected to the flexible substrate, and an upper end face of the waterproof layer being higher than the upper end face of the switch trace layer.

15. The membrane switch according to claim 1, wherein the switch trace layer is a copper foil trace pattern etched on a surface of the flexible substrate, the copper foil trace pattern comprising a pair of meandering-shaped copper foil traces that are not in contact with each other, each of the meandering-shaped copper foil traces being provided with at least one conductive contact; wherein one of the meandering-shaped copper foil traces is a positive pole trace and the other of the meandering-shaped copper foil traces is a negative pole trace; and the positive pole trace and the negative pole trace are conducted in the case that the conductor is in contact with the conductive contacts on the two meandering-shaped copper foil traces.

16. The membrane switch according to claim 1, wherein the switch trace layer is a copper foil trace pattern etched on a surface of the flexible substrate, the copper foil trace pattern comprising a pair of comb finger-shaped copper foil traces that are not in contact with each other and interdigitated, each of the comb finger-shaped copper foil traces being provided with at least one conductive contact; wherein one of the comb finger-shaped copper foil traces is a positive pole line and the other of the comb finger-shaped copper foil traces is a negative pole trace.

17. A key, comprising a membrane switch, the membrane switch comprising: a flexible substrate; a switch trace layer, disposed on a front surface of the flexible substrate, and comprising a plurality of conductive contacts that not in contact with each other; a flexible key, covering the switch trace layer, and defining a press cavity with the flexible substrate; and a conductor, disposed in the press cavity, and configured to be connected to the plurality of conductive contacts in response to the flexible key being pressed, such that the switch trace layer is conducted; further comprising a light-emitting assembly; wherein the light-emitting assembly is integrated on the flexible substrate and configured to generate a light beam, the light-emitting assembly comprises a light-emitting circuit integrated on a back surface of the flexible substrate, and the front surface of the flexible substrate is provided with a plurality of sites that are conducted to the light-emitting circuit; wherein the plurality of sites surrounding outside the flexible key, and a built-in drive IC-mounted LED is mounted on each of the sites.

18. A keyboard, comprising a keyboard substrate, the keyboard substrate being provided with a plurality of keys, the key comprising a membrane switch; wherein the membrane switch comprises: a flexible substrate; a switch trace layer, disposed on a front surface of the flexible substrate, and comprising a plurality of conductive contacts that not in contact with each other; a flexible key, covering the switch trace layer, and defining a press cavity with the flexible substrate; and a conductor, disposed in the press cavity, and configured to be connected to the plurality of conductive contacts in response to the flexible key being pressed, such that the switch trace layer is conducted; further comprising a light-emitting assembly; wherein the light-emitting assembly is integrated on the flexible substrate and configured to generate a light beam, the light-emitting assembly comprises a light-emitting circuit integrated on a back surface of the flexible substrate, and the front surface of the flexible substrate is provided with a plurality of sites that are conducted to the light-emitting circuit; wherein the plurality of sites surrounding outside the flexible key, and a built-in drive IC-mounted LED is mounted on each of the sites.

* * * * *